United States Patent [19]

Sartorio

[11] Patent Number: 5,076,091

[45] Date of Patent: Dec. 31, 1991

[54] UNIT FOR BENDING SHEET METAL AND A DEVICE FOR MANIPULATING SHEET METAL

[75] Inventor: Franco Sartorio, Turin, Italy

[73] Assignee: Amada Company, Limited, Japan

[21] Appl. No.: 612,625

[22] Filed: Nov. 14, 1990

[30] Foreign Application Priority Data

Nov. 16, 1989 [IT] Italy ..... 68011 A/89
Nov. 30, 1989 [IT] Italy ..... 68063 A/89

[51] Int. Cl.[5] ..... B21D 43/00; B25J 13/10; B25J 15/06

[52] U.S. Cl. ..... 72/422; 72/420

[58] Field of Search ..... 72/386, 389, 419, 420, 72/422, 461

[56] References Cited

U.S. PATENT DOCUMENTS

| | | | |
|---|---|---|---|
| 4,648,786 | 3/1987 | Sakurai | 414/752 |
| 4,795,124 | 1/1989 | Nagai | 73/422 |
| 4,827,757 | 5/1989 | Sartorio | 72/422 |
| 4,989,444 | 2/1991 | Murakami et al. | 72/422 |

FOREIGN PATENT DOCUMENTS

| | | | |
|---|---|---|---|
| 224529 | 7/1985 | Fed. Rep. of Germany | 72/422 |
| 3407445 | 9/1985 | Fed. Rep. of Germany | 72/420 |
| 55-128334 | 10/1980 | Japan | 72/420 |
| 63-126619 | 5/1988 | Japan | 72/420 |
| 2178987 | 2/1987 | United Kingdom | 72/420 |

*Primary Examiner*—Robert L. Spruill
*Attorney, Agent, or Firm*—Wigman & Cohen

[57] ABSTRACT

A unit (1) for bending sheet metal (38) comprises a bending press (2), a device (4) for manipulating the sheet metal (38), and an auxiliary gripping device (16) for turning the metal sheet through 180° about an axis (D) perpendicular to the bending line (B) of the press (12). The auxiliary gripping device (6) includes a plurality of grippers (36). The grippers (36) are carried by a support (24) fixed to the base structure (8) of the press (12) above the manipulation space (MS) at a height so that, when the grippers are above the manipulation space (MS), the auxiliary device (16) does not obstruct access of operators to the press (2) if the press is used manually. A device (111) for manipulating sheet metal (222) for a bending press (444) includes a main device (100) which is slidable along a guide beam (160) fixed parallel to the bending line (J) of the press (444) and an auxiliary gripping device (240) for turning the metal sheet over about an axis (L) perpendicular to the bending line (J). The auxiliary gripping device (240) is carried by the main device (100) of the manipulator device (111) and the guide beam (160) has a flattened shape so that, when the manipulator device (111) is in an inoperative position at the side of the press (444), the auxiliary device (240) does not obstruct access to the press (444) and the guide beam (160) can be used as a platform by operators engaged in the manual manipulation of pieces of metal sheet.

12 Claims, 11 Drawing Sheets

UNIT FOR BENDING SHEET METAL AND A DEVICE FOR MANIPULATING SHEET METAL

BACKGROUND OF THE INVENTION

1. Field of the Invention

The present invention relates to a unit for bending pieces of metal sheet.

The present invention also relates to a device for manipulating pieces of metal sheet for a bending press.

2. Description of the Prior Art

An Italian Patent Application No. 67224-A/88A filed on Mar. 15, 1988 (having a counterpart U.S. Pat. No. 5,042,287) discloses a unit for bending pieces of metal sheet, and a device for manipulating pieces of metal sheet for a bending press having a punch and a die.

The unit for bending pieces of metal sheet includes:

a device for manipulating pieces of metal sheet, provided with gripping means for gripping a piece of metal sheet and manipulating it during the automatic operating cycle, and an auxiliary gripping device for turning a piece of metal sheet through 180° about an axis perpendicular to the bending line, comprising at least one pair of grippers mounted for rotation about the said axis perpendicular to the bending line and movable between a first position in which they are situated in a manipulation space in front of the loading region of the press and a second position in which they are situated outside the manipulation space.

The device for manipulating pieces of metal sheet for a bending press having a punch and a die which cooperate each other along a bending line includes:

a base structure slidable along a fixed guide beam parallel to the bending line and carrying a pair of gripping members for gripping a piece of metal sheet and for moving it during an automatic bending cycle, and an auxiliary gripping device for turning a piece of metal sheet over about an axis perpendicular to the bending line, including at least one pair of grippers mounted for rotation about the axis perpendicular to the bending line.

In the bending unit and the manipulator device described in the above mentioned Italian Patent Application, the auxiliary gripping device is fixed to the floor in front of the press, on the opposite side of the manipulator device. This arrangement means that the auxiliary gripping device constitutes an obstacle when it is necessary for the press to be used manually, that is, without the use of the manipulator device, or when access to the press is required for maintenance.

SUMMARY OF THE INVENTION

It is therefore an object of the present invention to provide a unit for bending pieces of metal sheet of the type specified above, the auxiliary device does not constitute an obstacle to access by operators if the press is used manually.

It is also an object of the present invention to provide a manipulator device of the type specified above which allows free access to the press for bending operations to be carried out manually or for maintenance and tooling operations and which also simplifies the transportation, installation and alignment of the device itself.

The first object is achieved by the provision of a bending unit of the type specified above, characterized in that the grippers of the auxiliary device are carried by a support fixed to the base structure of the press above the manipulation space at a height so that the grippers are out of the manipulating space.

The second object is achieved by the provision of a manipulator device of the type defined above, characterized in that the auxiliary gripping device is carried by the base structure of the manipulator device and in that the guide beam has a flattened shape so that, when the manipulator device is in an inoperative position at the side of the press, the auxiliary device does not obstruct access to the press and the guide beam can be used as a platform by operators engaged in the manual manipulation of pieces of metal sheet.

DETAILED DESCRIPTION OF THE PREFERRED EMBODIMENT

Figure 1:
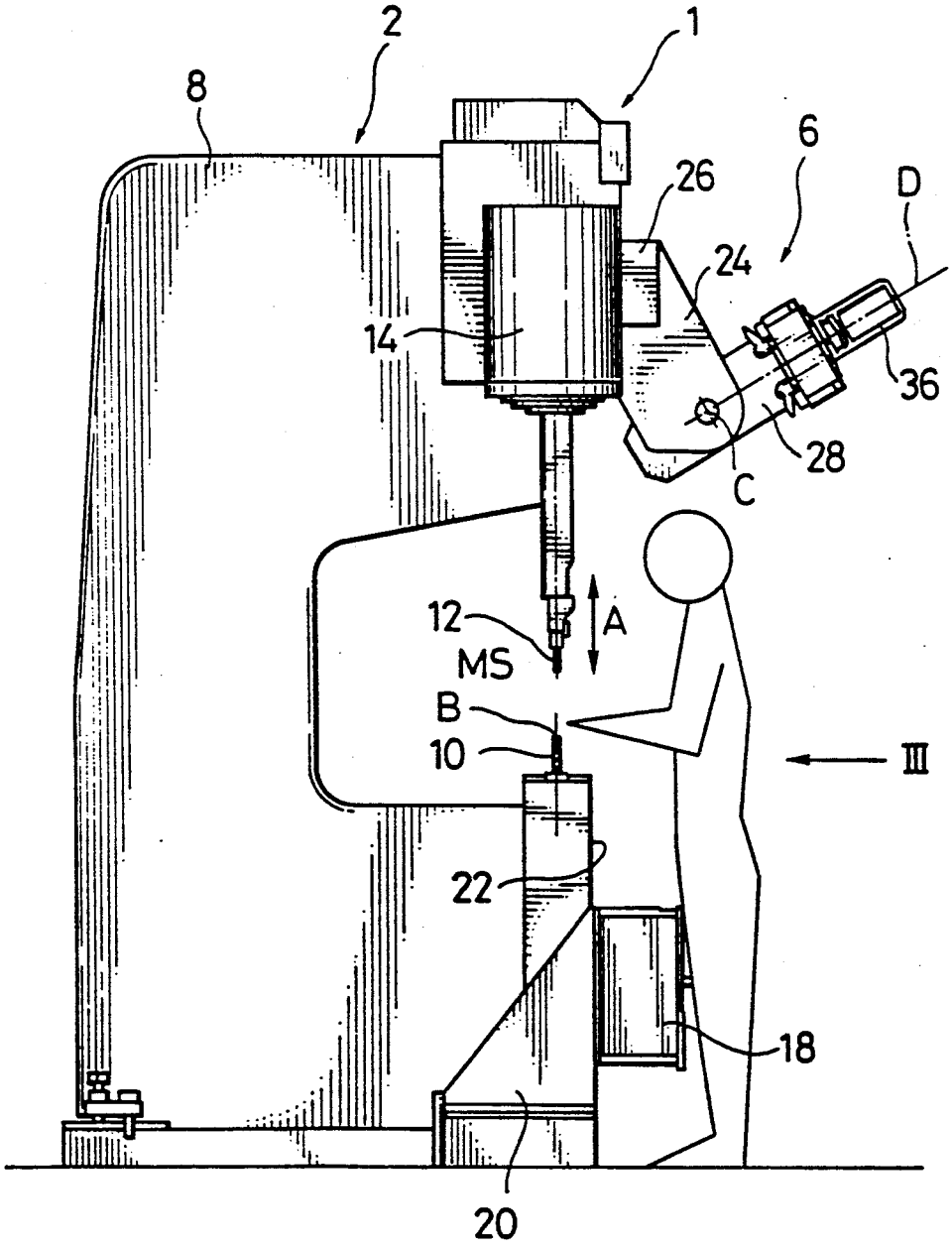
FIGS. 1 and 2 are side elevations of the bending unit of the present invention.
Figure 2:
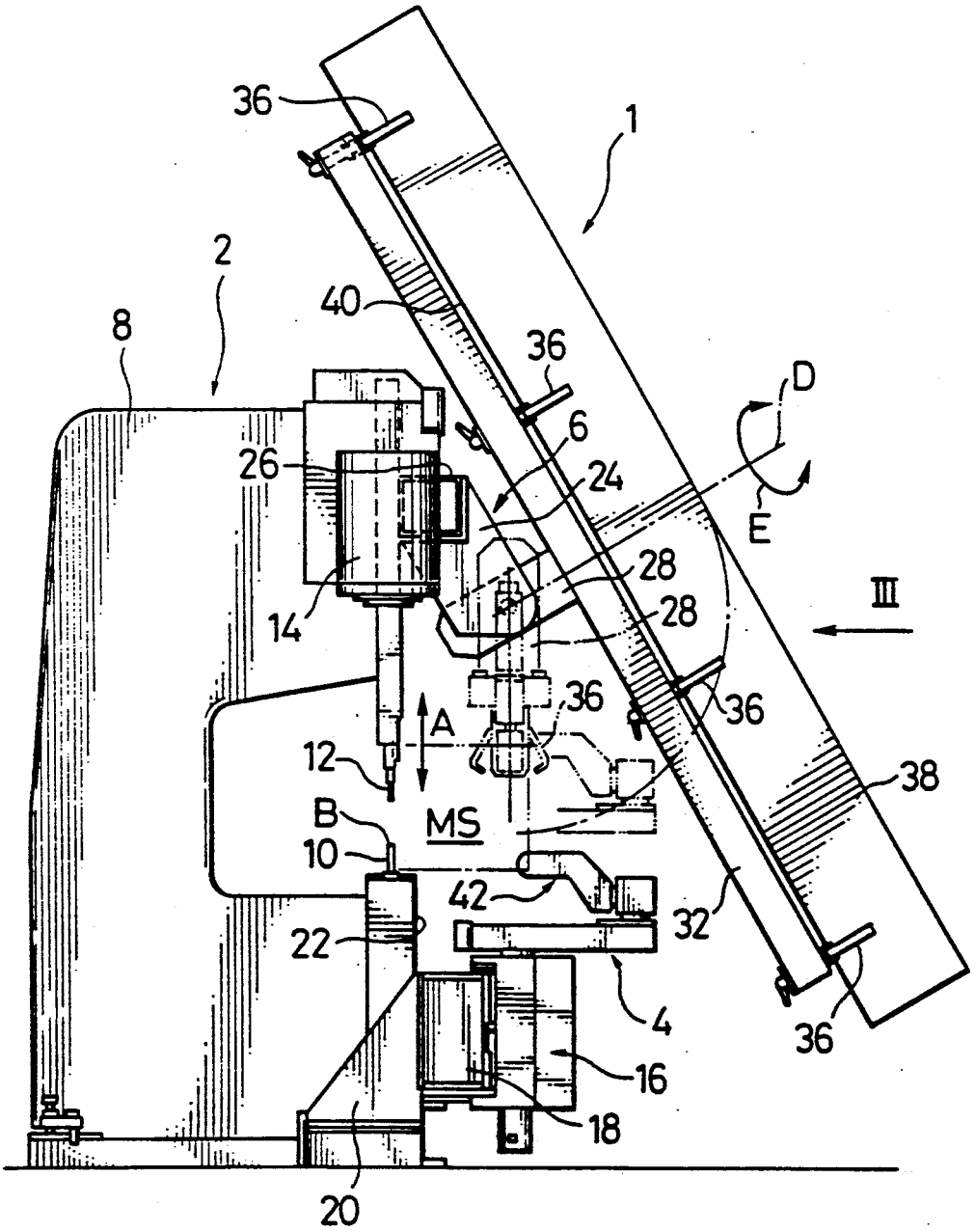
Figure 3:
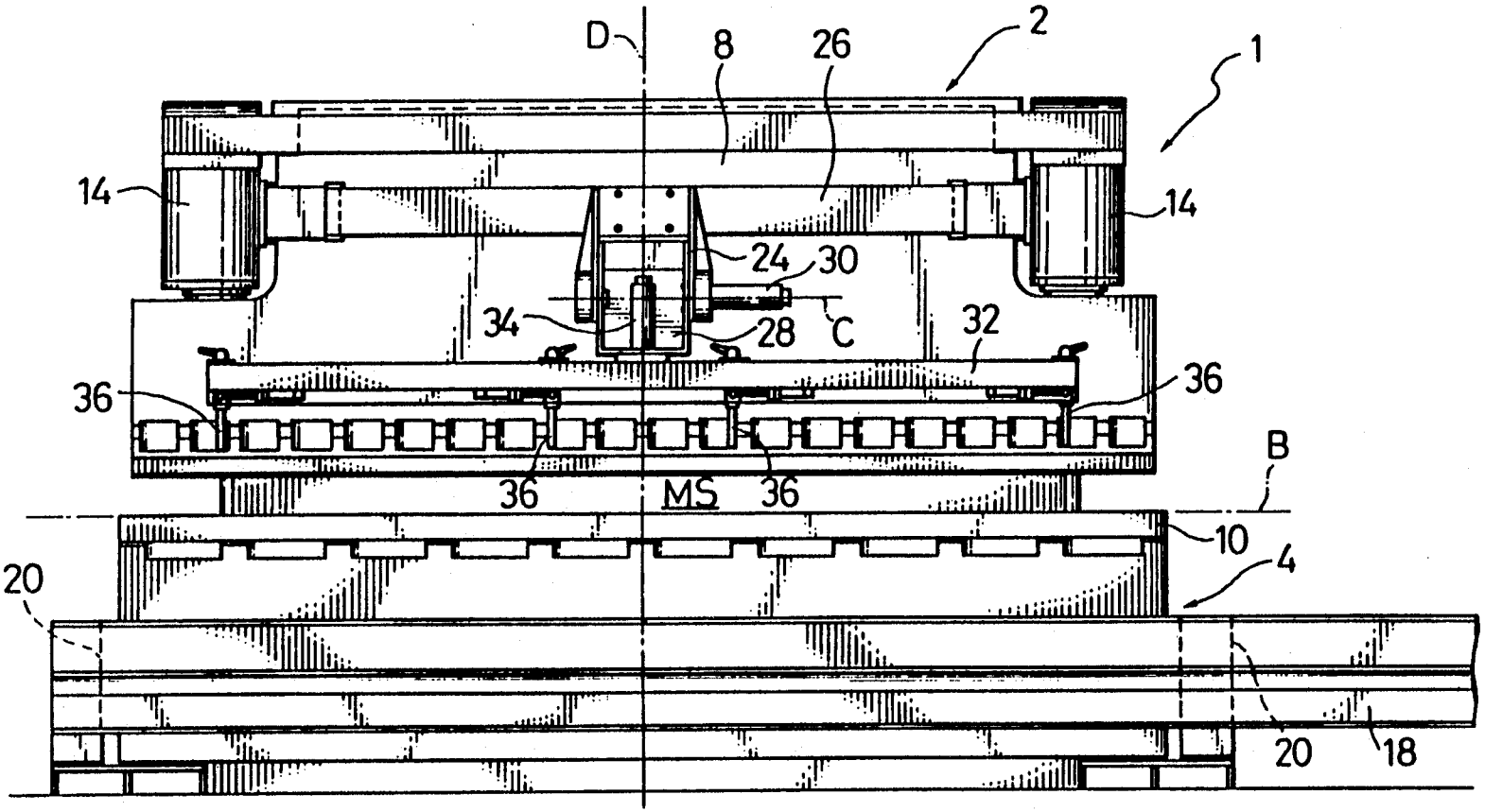
FIG. 3 is a front view taken on the arrow III of FIGS. 1 and 2.

In FIGS. 1–3, there is shown a unit 1 of the present invention for bending metal sheets. The unit includes a bending press 2, a manipulation device 4, and an auxiliary gripping device 6.

The press 2 is of known type, and includes a base structure 8 of generally C-shaped configuration which carries a fixed die 10 and a punch 12 driven by a pair of actuators 14 to move in the direction indicated by the double arrow A. The punch 12 and the die 10 cooperate along a bending line B which is perpendicular to the plane of the drawings in FIGS. 1 and 2.

The manipulation device 4 shown schematically in FIGS. 2 and 3 is preferably of the type described and illustrated in the Italian Patent Application No. 67224-A/88 mentioned above. This device includes a carriage 16 mounted for sliding on a guide beam 18 which extends parallel to the bending line B. The beam 18 is fixed to the floor by means of end supports 20 and is as close as possible to the structure 8 of the press 2 so as to be almost in contact with the front wall 22 of the press 2. The space occupied by the beam 18 is thus as small as possible and the beam 18 does not obstruct the movements of operators if the press 2 is used manually (FIG. 1).

The auxiliary gripping device 6 includes a support 24 fixed to a cross member 26 whose ends are fixed to the cylinders of the hydraulic actuators 14 which are fixed to the base structure 8 of the press 2. The auxiliary device 6 also includes a motor-driven arm 28 one end of which is articulated to the support 24 about an axis C parallel to the bending line B. The arm 28 is driven by means of an electric motor 30 controlled by a conventional control unit (not shown) and is movable between a first working position shown in broken outline in FIG. 2 and a second working position shown in continuous outline in that drawing. At its free end, the arm 28 carries a bar 32 which is rotatable relative to the arm 28 about an axis D perpendicular to the articulation axis C of the arm 28. The arm 28 carries an electric motor 34 for rotating the bar 32 in the senses indicated by the double arrow E in FIG. 2.

The bar 32 has a plurality of grippers 36 for gripping a piece of metal sheet 38 along a marginal region adjacent its longitudinal edge 40 (FIG. 2).

The manipulation device 4 comprises, in known manner, a pair of motor-driven manipulation heads 42 which are translatable in three perpendicular directions and rotatable about an axis parallel to the bending line in space in front of the loading region of the press 2, which will be referred to below as the manipulation space and is indicated MS in the drawings.

During an automatic bending cycle, the piece 38 is manipulated by means of the manipulation heads 42 of the device 4. The auxiliary device 6 is normally situated in its second working position in which the grips 36 are situated outside the manipulation space MS so as not to hinder the movement of the heads 42 of the manipulation device 4. When it is necessary to turn the piece 38 through 180° about an axis perpendicular to the bending line B in order to form reverse bends in the piece 38, the auxiliary device 6 is brought to its first working configuration shown in broken outline in FIG. 2. Under the control of the control unit, the auxiliary device 6 grips the piece 38 and is brought to its second working position. In this position, the auxiliary device 6 turns the piece 38 about the axis D; an intermediate position of the auxiliary device 6 during turning is shown in continuous outline in FIG. 2. The auxiliary device 6 is then returned to its first working position in which it offers the piece 38 back to the heads 42 of the manipulation device 4. As can be seen in FIG. 2, the axis D extends vertically in the position in which the piece 38 is gripped and released. This arrangement assists the precise positioning of the piece 38 and simplifies calibration operations both for the positioning of the bar 32 and for its arrangement parallel to the bending line B. Moreover, with the axis D arranged vertically, the bar 32 is only subject to bending along its principal axis of inertia whereas, if the axis D were inclined to the vertical at an angle between 0° and 90°, the bar 32 would be subject to torsion because of the weight of the piece 38 and to bending along an axis which does not coincide with a principal axis of inertia. In this case, the deformation of the bar 32 would cause the piece of sheet metal to move out of the plane in which it was lying and would cause problems at the subsequent stage when the auxiliary device 6 returns the piece 38 to the manipulation device 4.

When it is necessary to use the press 2 manually, the auxiliary device 6 is brought to the configuration shown in FIG. 1. The manipulation device 4 is slid along the beam 18 and brought out of the working area to a position in which it does not obstruct the movements of operators employed in the manual operation.

As can be seen in FIG. 1, the support 24 of the auxiliary device 6 is fixed to the structure 8 of the press 2 at a height such as not to obstruct the operators' access to the loading region of the press 2. Safety means (not shown) may be provided for retaining the arm 28 of the auxiliary device 6 in its raised position and preventing it from falling accidentally.

In FIGS. 4–10, there shown is a manipulator devices 111 of the present invention. The manipulator devices 111 is a single unit consisted mainly of a main device 100 and an auxiliary device 240.

Figure 4:
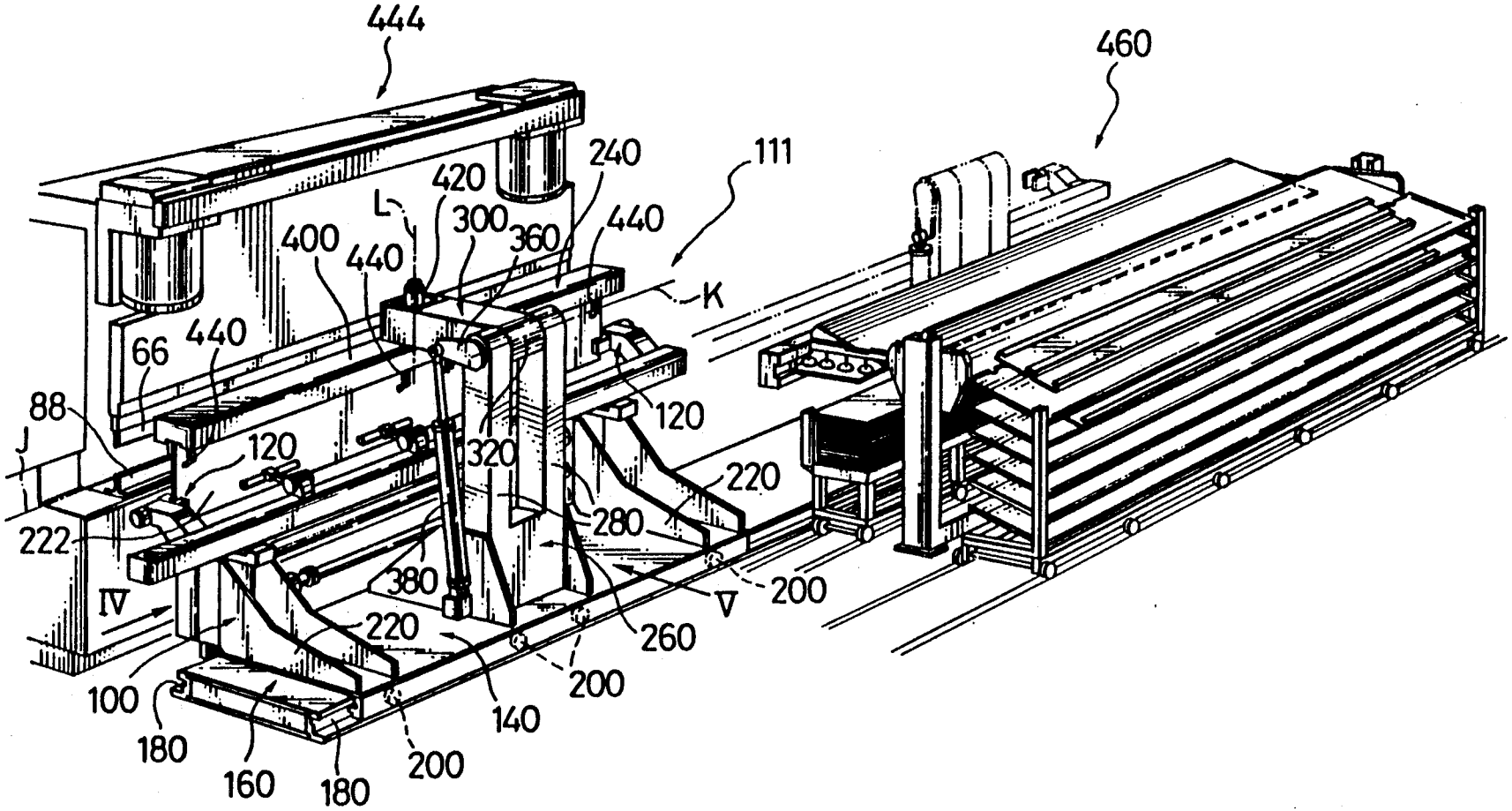
FIG. 4 is a perspective view of a manipulator device of single unit of the present invention associated with a bending press.
Figure 4A:
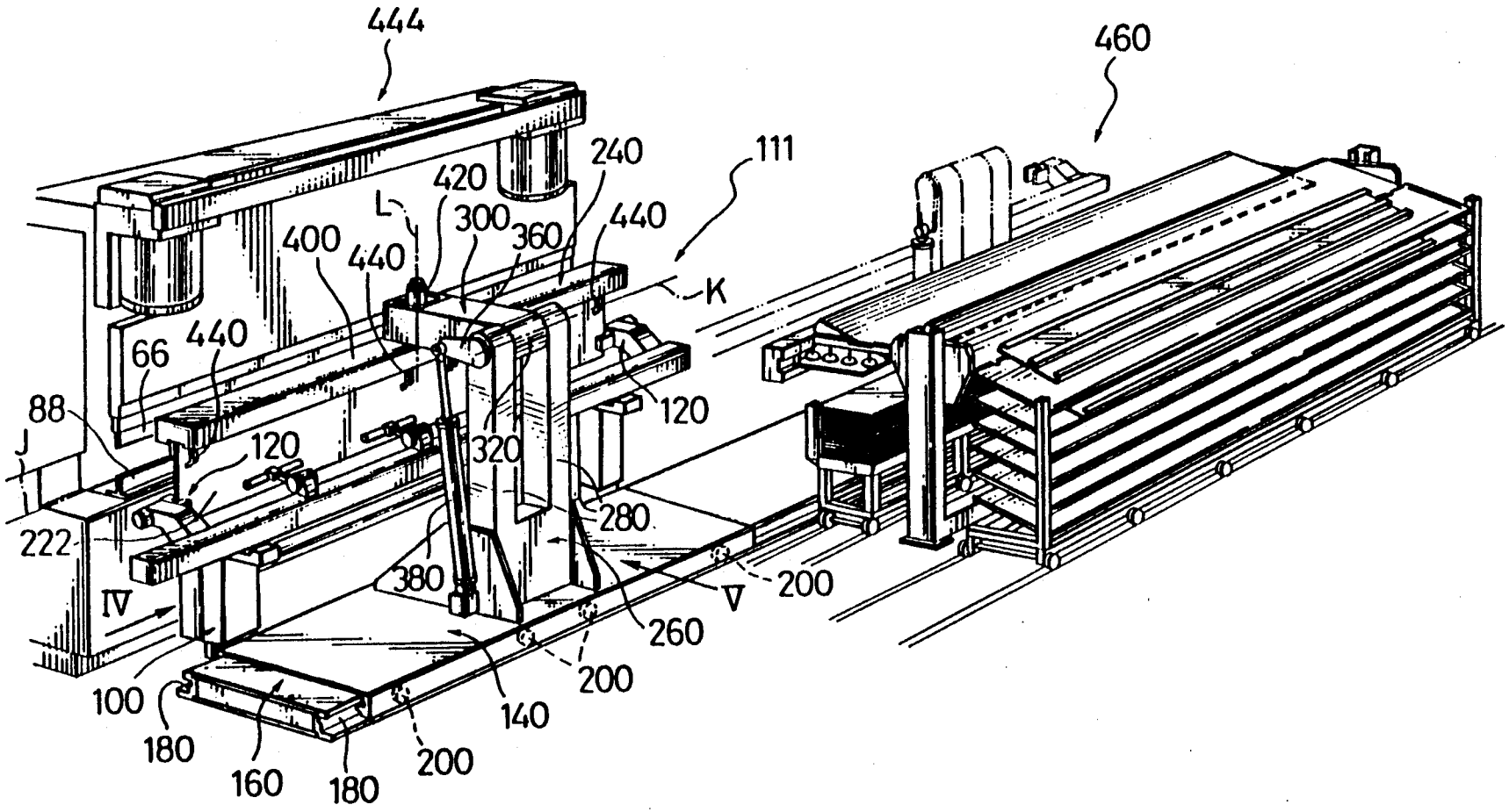
FIG. 4*a* is a perspective view of a manipulator device similar to the device shown in FIG. 4, but including separate two units.

In FIG. 4*a*, there is shown another manipulator devices 111, of the present invention, which consists of separate two units of a main device 100 and an auxiliary device 240 both of which are respectively movable transversely and independently from each other. The structure and operation of the main device 100 are described in detail in the Italian Patent Application No. 67224-A/88 mentioned above.

The main device 100 shown in FIGS. 4 and 4*a* manipulates a piece of metal sheet 222 to a bending press 444 and to a loading and unloading device 460. The press 444, in known manner, includes an upper, movable punch 66 and a lower, fixed die 88 which cooperate along a bending line J. The main device 100 carries a pair of gripping members 120 each of which is translatable in three perpendicular directions and is rotatable about an axis parallel to the bending line J.

The main device 100 of the manipulator device 111 of FIG. 4 is mounted on a platform 140 slidable in a direction parallel to the bending line J of the press 444. The guide beam 160 extending parallel to the bending line J and fixed to the floor in front of the press 444. The guide beam 160 has a flattened rectangular shape in cross-section and has a pair of guides 180 with channel-shaped cross-sections along its longitudinal sides. The guides 180 of the beam 160 are engaged by horizontal-axis wheels 200 carried by the platform 140. A pair of uprights 220 are fixed on the platform 140, forming a part of the main device 100 of the manipulator device 111. An auxiliary gripping device 240 is arranged between them. The auxiliary device 240 includes a columnar frame 260 fixed to the platform 140 of the manipulator device 111 and having a pair of uprights 280 between which is situated an arm 300, one end 320 of which is articulated to the upright 280 about an axis K parallel to the bending line J. The arm 300 is driven by means of an electric motor 340 which can be seen in FIG. 5 and 6 and which is controlled by a conventional electronic control unit (not shown). A crank 360 is fixed to the end 320 of the arm 300 and is connected to one end of a pressurized-fluid actuator 380 the other end of which is articulated to the framework 260 of the auxiliary device 240. The fluid actuator 380 exerts a force on the arm 300 through the crank 360 which tends to compensate for the weight bearing on the arm 300. At its free end the arm 300 carries a bar 400 mounted for rotation relative to the arm 300 about an axis L perpendicular to the bending line J. The bar 400 is rotatable about the axis L by means of an electric motor 420 carried by the arm 300. The bar 400 is provided with a plurality of grippers 440 at one of its longitudinal edges for gripping the edge portion of a piece of sheet metal 222.

Figure 5:
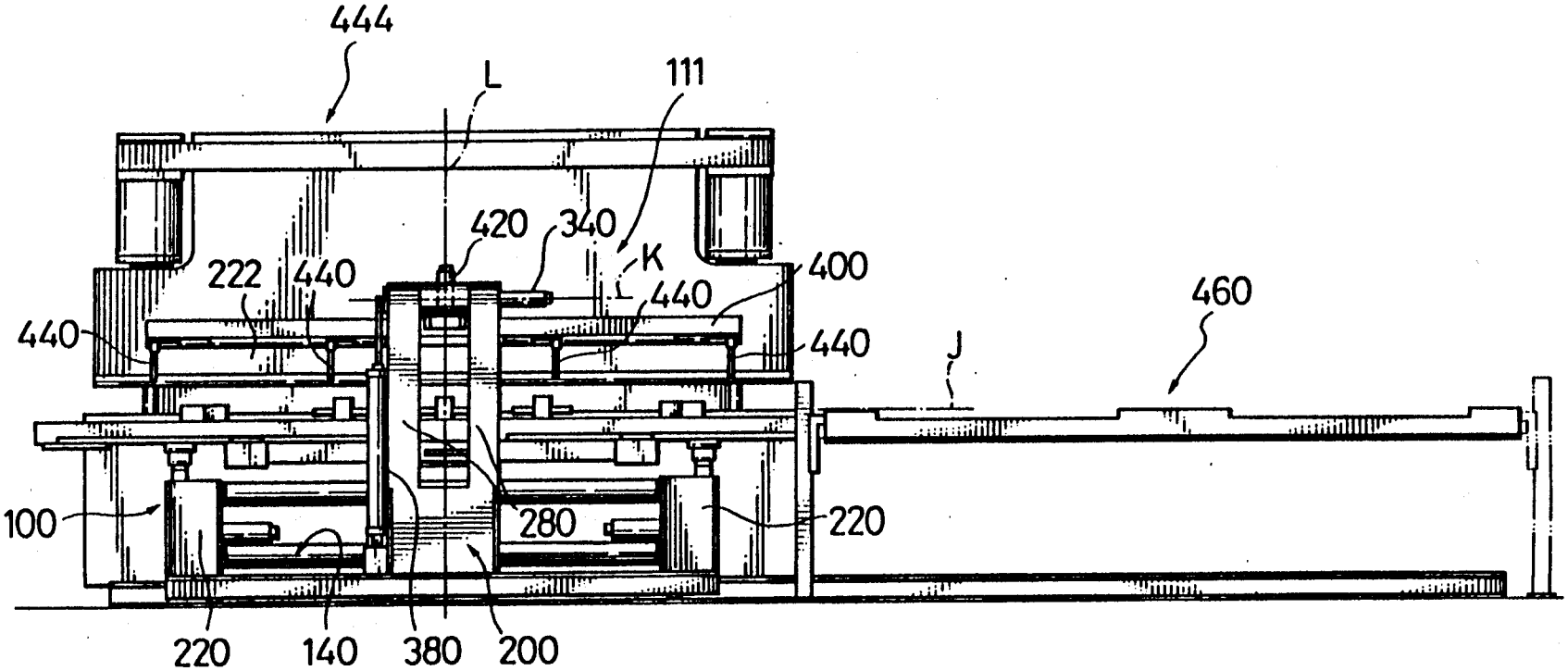
FIGS. 5 and 6 are front views taken on the arrow V of FIG. 4 in two different working configurations.
Figure 6:
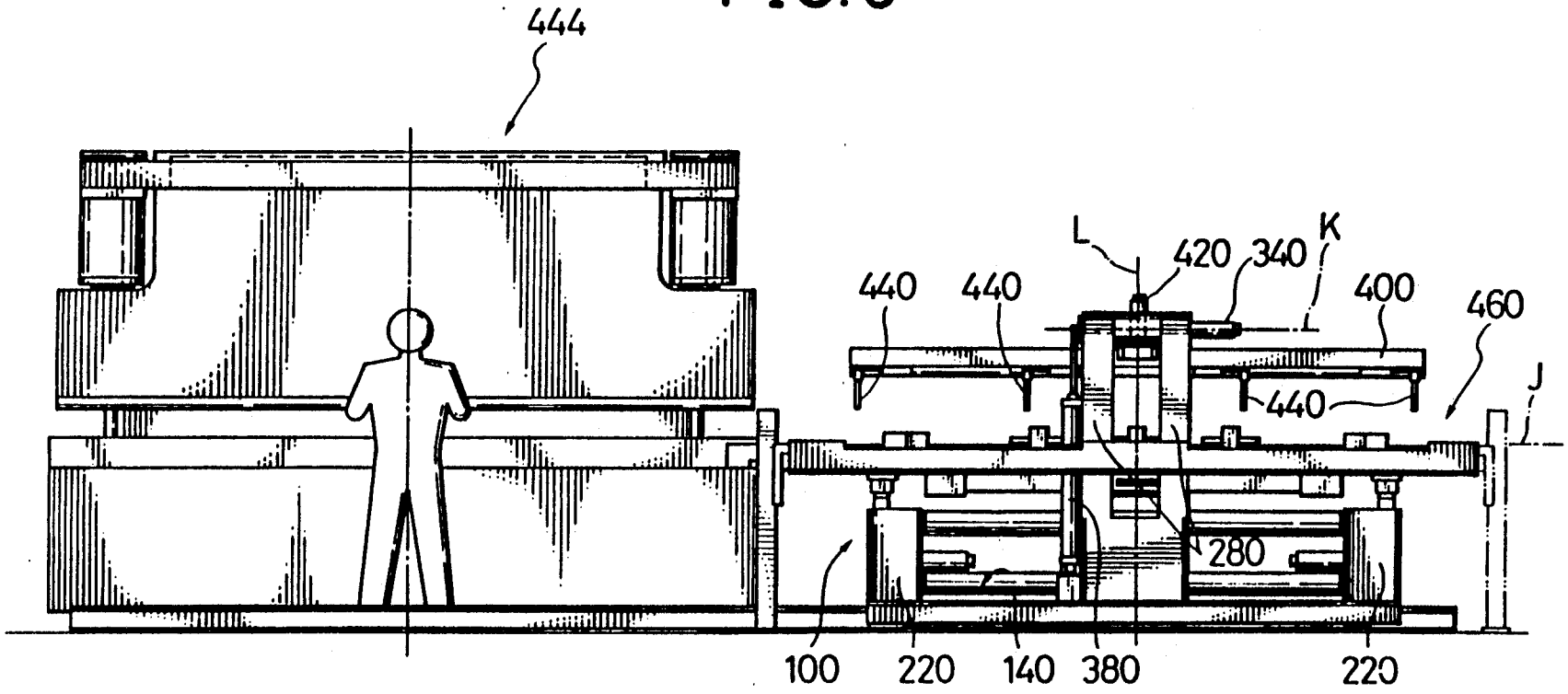

FIG. 5 shows the manipulator device 111 in an operative condition during the manipulation of a metal sheet piece 222. When it is necessary to use the press 444 manually, or when maintenance operations have to be carried out on the press 444, the manipulator device 111 moves along the guide beam 160 into an inoperative configuration, as shown in FIG. 6, in which it is located beside the press 444 and does not obstruct the manual manipulation of the metal sheet piece or the maintenance operations. When the manipulator device 111 is in its inoperative position (FIG. 6), the guide beam 160 forms a platform which can be used by an operative engaged in the manual manipulation of metal sheet pieces (see FIG. 6).

As will become clear from the following, the inoperative position of the manipulator device 111 coincides with the configuration in which a metal sheet piece which is to be subjected to a bending cycle is loaded and in which a piece is unloaded upon completion of the automatic bending cycle.

Figure 7:
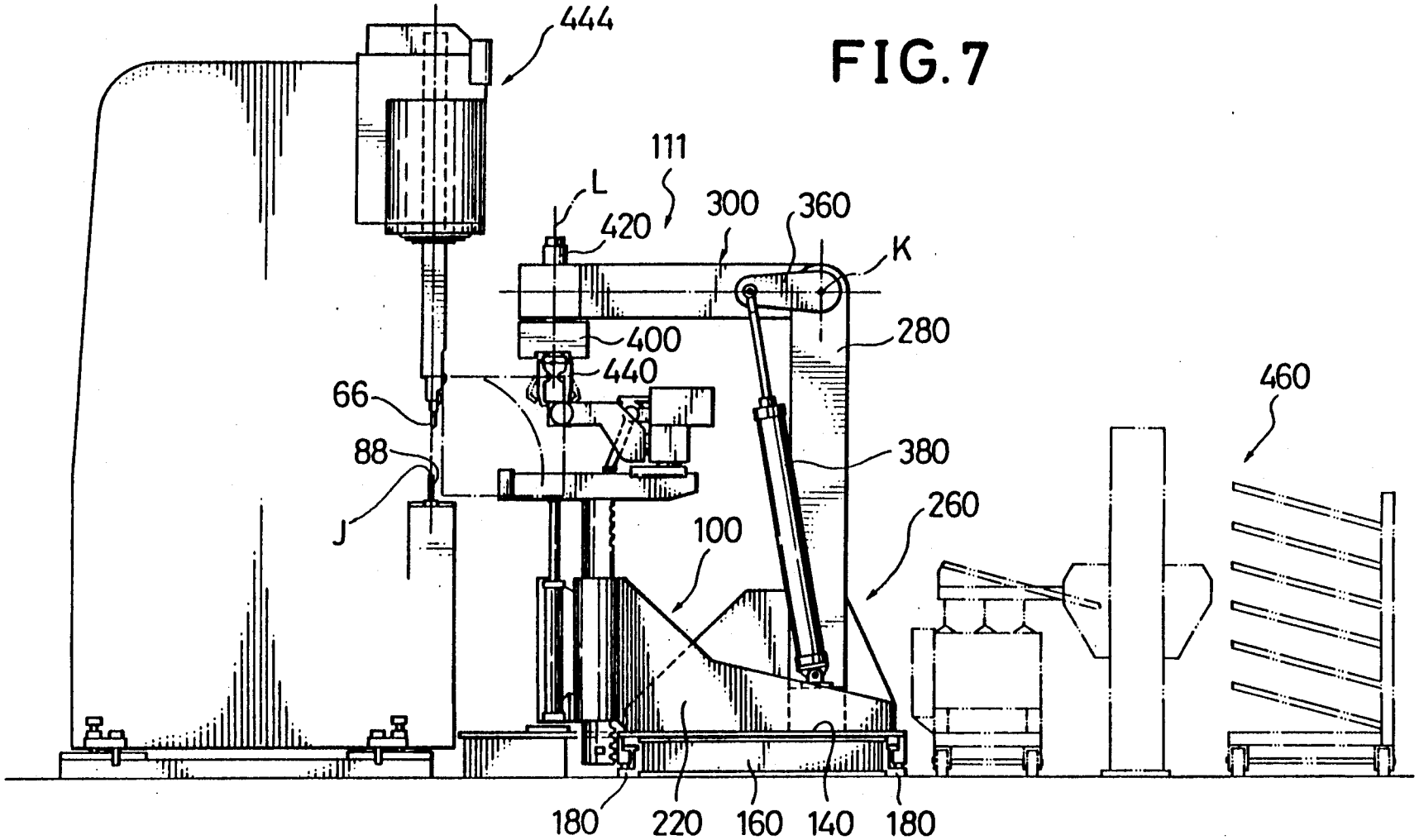
FIGS. 7 to 10 are side views taken on the arrow IV of FIG. 4 showing an operating sequence of the manipulator device according to the present invention.

FIGS. 7 to 10 show an operative sequence of the manipulator device 111. In FIG. 7, the arm 300 of the auxiliary gripping device 240 extends horizontally and, consequently, the axis L of rotation of the bar 400 is vertical. In this configuration, the grippers 420 of the auxiliary device 240 extend in a manipulation space MS in front of the loading region of the press 444. In the configuration shown in FIG. 7, the common gripping plane of the grippers 440 extends vertically and the auxiliary gripping device 240 is arranged to pick up a piece of metal sheet 222 supported by the gripping members 120 of the manipulator device 111.

Figure 8:
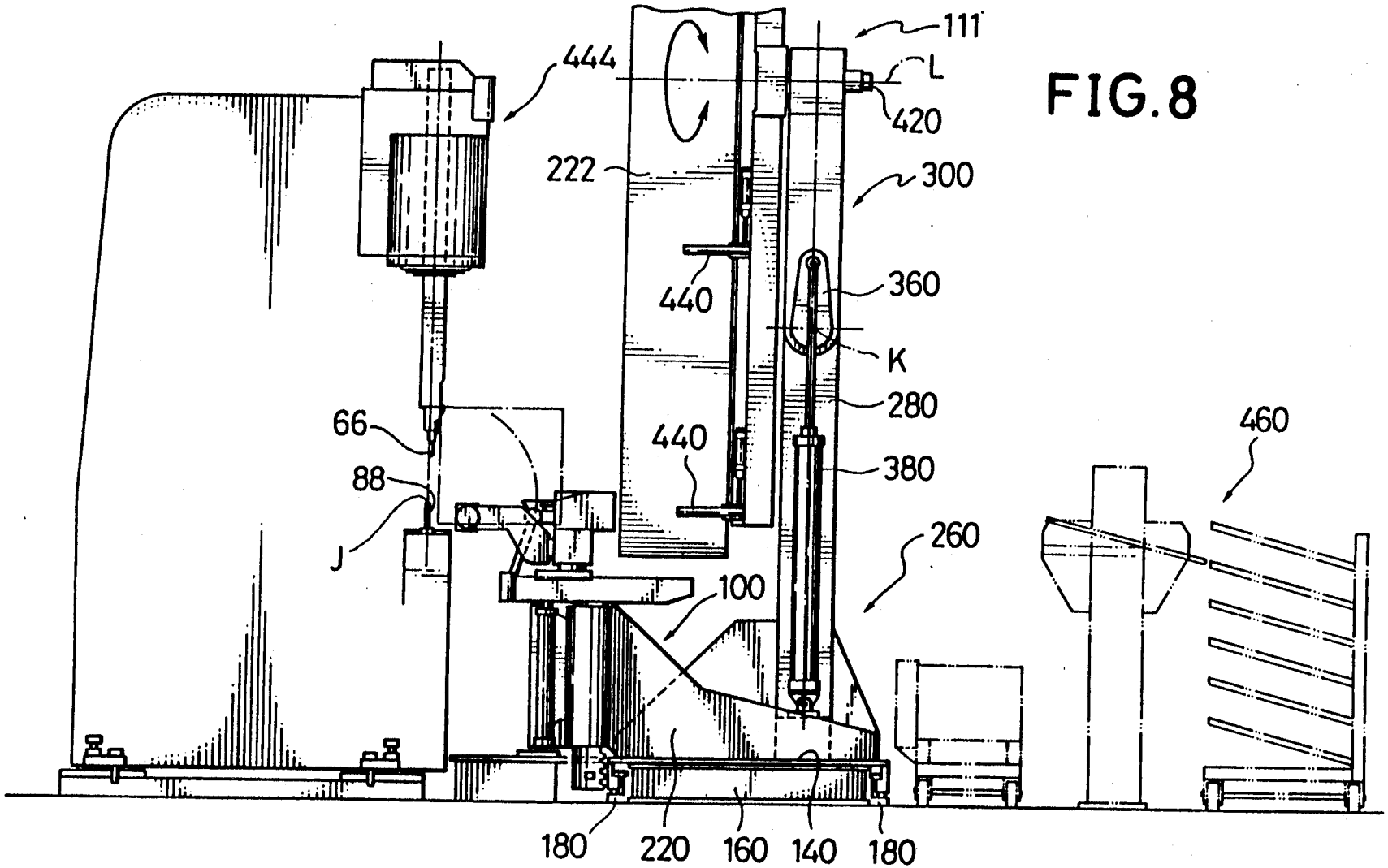

When it is necessary to form reverse bends in the piece 222 being worked, the piece 222 must be turned through 180° about an axis perpendicular to the bending line J. In order to effect this overturning, after the auxiliary gripping device 240 has gripped the metal sheet piece 272 as described with reference to FIG. 7, it is brought to a configuration, in which the axis L of rotation of the bar 400 extends horizontally. In this configuration, the bar 400 is rotated through 180° about the axis L. In FIG. 8, the auxiliary gripping device 240 is shown at an intermediate stage in this rotation.

In order to carry out the operations shown in FIGS. 7 and 8, the manipulator device 111 is situated in front of the press 444 in the position shown in FIG. 5.

Figure 9:
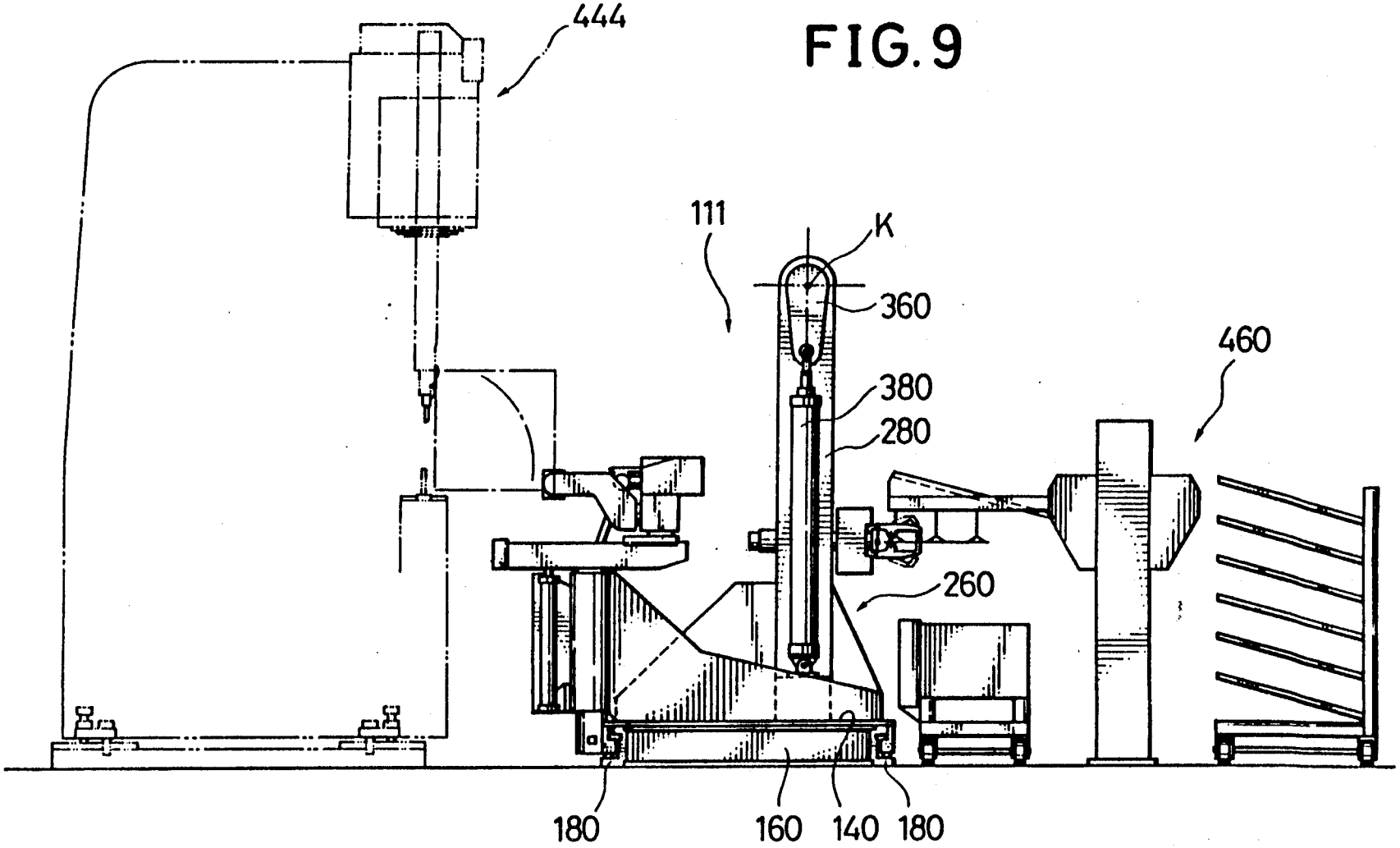
Figure 10:
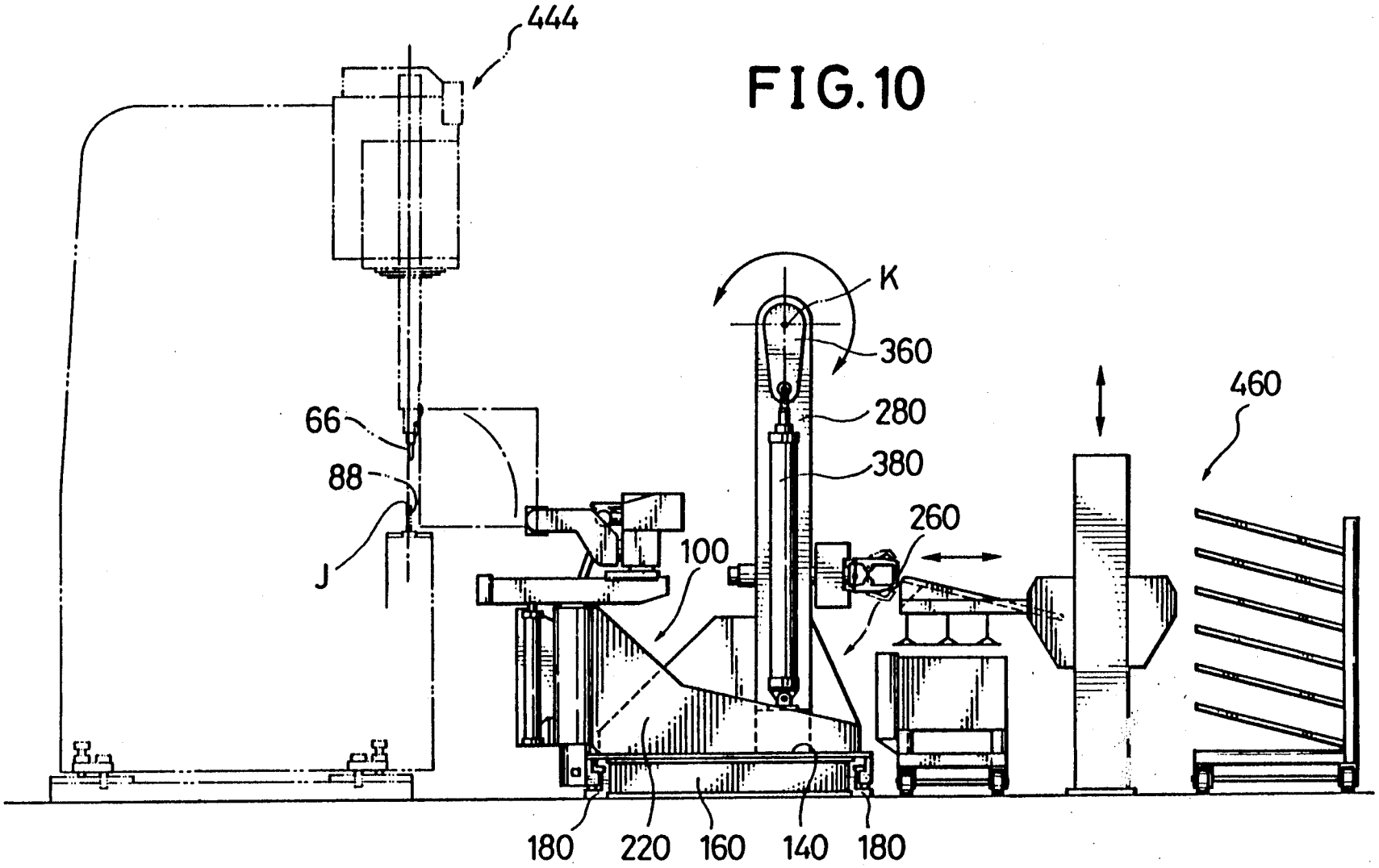

As shown in FIGS. 9 and 10, the auxiliary gripping device 240 is also used for picking up a piece of metal sheet 222 which is to be subjected to an automatic bending cycle and for discharging the piece when the operation has been completed (FIG. 10). FIGS. 9 and 10 show schematically a device 460 which governs the loading and unloading of the pieces of metal sheet; this device is described in detail in the Italian Patent Application entitled "A device for transferring metal sheet" filed on the same date by the same Applicant. In order to load and unload the metal sheet pieces 222, the auxiliary device 240 is brought to the configuration shown in FIGS. 9 and 10, in which the axis L is horizontal and the grippers 440 face away from the press 444. In order for the picking-up and discharging operations to be carried out, the manipulator device 111 is situated in the same position as that shown in FIG. 6, that is, at the side of the press 444 and in front of the loading and unloading device 460.

For the manipulation device shown in FIG. 4*a*, only the auxiliary device 240 or both the main device 100 and the auxiliary device 240 are moved to the side of the press 444 when it is necessary or preferable to do so. The auxiliary device 240 is operated in the same manner as described above for the device shown in FIGS. 4–10.

Naturally, the principle of the invention remaining the same, the forms of embodiment and details of construction may be varied widely with respect to those described and illustrated without thereby departing from the scope of the present invention.

What is claimed is:

1. A unit for bending pieces of metal sheet, including:

a bending press with a punch and a die which cooperate along a bending line, a device for manipulating pieces of metal sheet, disposed in front of the press provided with gripping means for gripping a piece of metal sheet, and an auxiliary gripping device for turning a piece of metal sheet through 180° about an axis perpendicular to the bending line, comprising at least a pair of grippers mounted on it to rotate about the said axis and movable between a first position of a manipulation space in front of a loading region of the press and a second position outside the manipulation space, characterized in that the grippers of the auxiliary device are carried by a support fixed to a base structure of the press above the manipulation space at a height such that, when the grippers are situated in the said second position, the auxiliary device does not obstruct the access of operators to the press.

2. A bending unit according to claim 1, characterized in that the manipulation device is mounted for sliding along a guide beam parallel to the bending line and is arranged substantially in contact with a front wall of the press.

3. A bending unit according to claim 1, characterized in that the support of the auxiliary gripping device is fixed to a cross member which is parallel to the bending line and ends of which are fixed to cylinders of a plurality of hydraulic actuators that operate the press.

4. A bending unit according to claim 1, characterized in that the auxiliary device is provided with a motor-driven arm articulated at its one end to the support about an axis parallel to the bending line.

5. A bending unit according to claim 4, characterized in that grippers of the auxiliary device are carried by a bar mounted on a free end of the motor-driven arm for rotation about an axis perpendicular to the bending line.

6. A bending unit according to claim 4, characterized in that the motor-driven arm extends vertically in the configuration corresponding to the first position of the auxiliary grippers.

7. A device for manipulating pieces of metal sheet for a bending press having a punch and a die which cooperate along a bending line, comprising:

a main device for manipulating a piece of metal sheet, which is disposed in front of the press, movable transversely of the press, and carries a pair of gripping members for gripping the piece of sheet metal, and an auxiliary gripping device for turning the piece of sheet metal over about an axis perpendicular to the bending line, including at least one pair of grippers mounted for rotation about the axis perpendicular to the bending line, characterized in that the auxiliary gripping device is carried by a platform slidably mounted on a low and flat guide beam disposed in front of the press, extended in a direction parallel to the bending line and fixed to a floor, and that a top surface of the guide beam is quite flat, so that when only the auxiliary device or both the main device and the auxiliary device are at one side of the press, the guide beam does not obstruct access by operators to the press and the main device, but can be used as a platform for the operators.

8. A device according to claim 7, characterized in that the main device is mounted on the platform to which the auxiliary gripping device is fixed, to form a single unit of the manipulator device.

9. The device according to claim 7 or 8, characterized in that the beam has a pair of guide channels at both sides, and that end portions of the platform are guided in grooves of the channels for sliding.

10. A device according to claim 7 or 8, characterized in that the auxiliary gripping device includes a columnar frame mounted on the said platform, the columnar frame having a pair of uprights located side by side, and an end of a motor-driven arm is articulated between the uprights and another end carrying a bar which carries the gripper and is rotatable about he said axis.

11. A device according to claim 10, characterized in that the motor-driven arm can assume a first, a second and a third operating configurations, in the first of which the grippers extend in a manipulation space in front of the loading region of the press with their common gripping plane extending substantially verticaly, in the second of which the axis of rotation of the bar carrying the grippers extends substantially horizontally so that the auxiliary device is arranged to effect the overturning of the metal sheet piece, and in the third of which the grippers face away from the press and can pick up a metal sheet piece to be subjected to an operating cycle or for discharging a piece of metal sheet upon completion of an operating cycle.

12. A device according to claim 10, characterized in that at least a crank is fixed to the end of the motor-driven arm which is articulated to the uprights of the frame and is connected to a pressurized-fluid actuator for exerting a reaction force on the arm which tends to balance the weight bearing on the arm.

* * * * *